United States Patent [19]

Mattenson

[11] 3,992,010

[45] Nov. 16, 1976

[54] PATH PUZZLE APPARATUS

[76] Inventor: Wallace O. Mattenson, 1732 Rose Arbor Drive, St. Louis County, Mo. 63141

[22] Filed: Apr. 7, 1975

[21] Appl. No.: 565,649

[52] U.S. Cl. ..... 273/130 R; 273/136 E; 273/137 AC

[51] Int. Cl.[2] ..... A63F 3/00

[58] Field of Search ..... 273/130 R, 130 D, 130 E, 273/131 R, 131 B, 131 F, 131 G, 134 G, 134 AB, 135 R, 135 D, 136 E, 137 R, 137 C, 137 D, 137 AC, 130, 134 AD

[56] References Cited

UNITED STATES PATENTS

| | | | |
|---|---|---|---|
| 1,798,701 | 3/1931 | Reed | 273/131 B |
| 3,309,092 | 3/1967 | Hardesty et al. | 273/137 D |
| 3,472,514 | 10/1969 | Green | 273/135 D |
| 3,695,615 | 10/1972 | Shoptaugh | 273/130 R |
| 3,820,791 | 6/1974 | Powers | 273/137 R |

FOREIGN PATENTS OR APPLICATIONS

| | | | |
|---|---|---|---|
| 430,249 | 6/1935 | United Kingdom | 273/134 AD |
| 515,816 | 12/1939 | United Kingdom | 273/134 C |

*Primary Examiner*—Anton O. Oechsle
*Assistant Examiner*—Harry G. Strappello

[57] ABSTRACT

A hexaturn game device comprising, a playing board provided with an array of hexagonally shaped apertures or spaces therein and a plurality of hexagonally shaped pieces adapted to fit loosely in said apertures, said pieces provided with a travel direction indicator and an indicia indicating aperture distance travel.

2 Claims, 2 Drawing Figures

PATH PUZZLE APPARATUS

BACKGROUND OF THE INVENTION

It is well known that games which allow the player to select angular and distance travel about a limited array playing board with the object being to end at the point of beginning or other preselected point with a limited selection of varied distance movements available to be selected provides a useful and challenging device.

SUMMARY OF THE INVENTION

In the present invention, a device is contemplated which in its preferred embodiment has an array of hexagonally shaped apertures or spaces in a playing board in combination with a plurality of hexagonally shaped pieces adapted to fit in said apertures or on the spaces and each of said pieces provided with a direction indicator and an aperture travel distance indicia.

It is a primary object of the invention to provide such a device which is simple, reliable, inexpensive and challenging.

With the above primary and other incidental objects in view which will more fully appear in the specification of the invention which is provided herein, the invention intended to be protected by Letters Patent consists of the features of construction of the parts and combinations thereof, and the mode of operation hereinafter described or illustrated in the accompanying drawings, or their equivalents.

BRIEF DESCRIPTION OF THE DRAWINGS

Referring to the drawings, wherein is illustrated a preferred but not the only form of embodiment of the invention.

DETAILED DESCRIPTION OF THE INVENTION

Figures 1, 2:
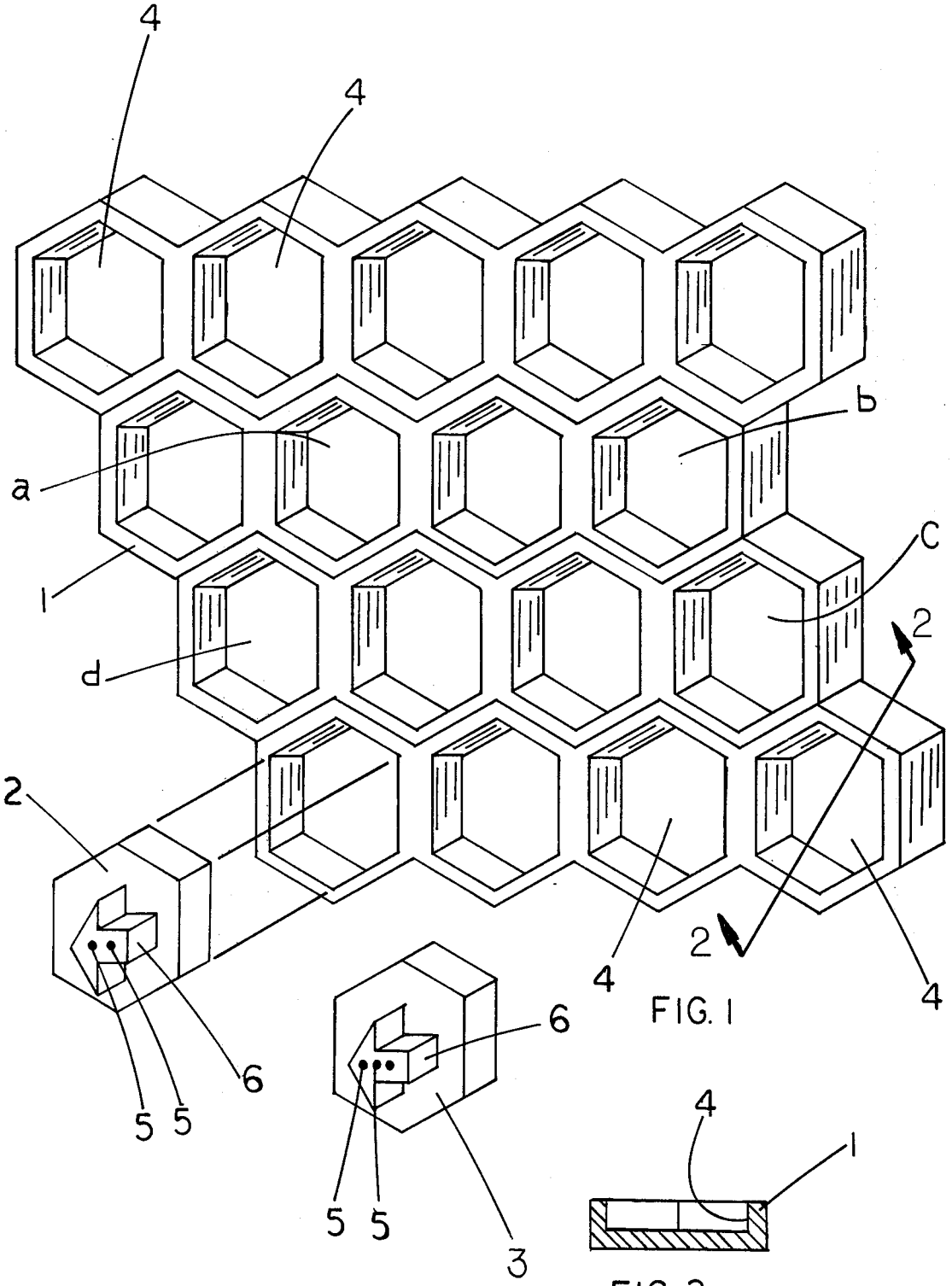
FIG. 1 is a perspective view of a hexaturn game constructed in accordance with and embodying the present invention.
FIG. 2 is a partial cross section of the device shown in FIG. 1.

Referring now to the drawing, in FIG. 1, the hexaturn game is shown to comprise board, 1, and a plurality of hex pieces, 2, and, 3.

As shown in FIG. 1, and FIG. 2, board 1, comprises a playing board with an array of hexagonally shaped apertures, 4. It should be clear that other arrays are contemplated in addition to that shown.

The hex pieces, 2, and 3, are representative of a set of hex pieces which are provided to the player.

An example of the play is as follows:

The player arbitrarily selects a starting aperture such as, *a*, in which he places a piece with a two dot indicia, 5, such that the arrow, 6, points to the right. The next piece will then be placed in aperture, *b*, (indicated by the indicia of two dots on the piece in aperture, *a*). Assuming the second piece chosen has an indicia, 5, of one dot and is placed in aperture, *b*, with the arrow, 6, directed southeastwardly on the board then the third piece will go in aperture, 3. Next assuming the player places a piece with indicia, 5, of three dots in aperture, *c*, and the arrow directed to the left on the board then the fourth piece must go into aperture, *d*. The object of the game being to end at the starting aperture, or some other preselected aperture, with the pieces available. The indicia, 5, are selected to vary the difficulty of the game. Thus the player has to decide at each aperture, a distance and direction.

It is also contemplated that the board consist of a flat board with the hexagon pattern painted on the board as opposed to having the apertures.

The foregoing illustrates a particular game which may be played on the array shown. It is contemplated that the array may be expanded or increased from that shown, that more than one player participates in competition. Also the game may be played by varying the number of pieces allotted to the player or having the pieces chosen at random and giving the player designated starting and ending positions or other equivalent game arrangements.

While I have illustrated and described the preferred embodiments of my invention, it is to be understood that changes and modifications in the form, construction, arrangement and combination of the parts and steps of the Path Puzzle Apparatus may be substituted for those herein shown and described without departing from the nature and principle of my invention.

Having thus described my invention, what I claim as new and desire to secure by United States Letters Patent is:

1. A path puzzle apparatus comprising, playing board provided with a plurality of hexagonally shaped apertures arrayed therein in combination with, a plurality of hexagonally shaped pieces for placement in said apertures, an arrow shaped direction indicating structure operably mounted on each of said pieces, said arrow disposed in a direction perpendicular to a side of said hexagon, travel distance indicia comprising a plurality of dots operably mounted on each of said arrow shaped indicating structures and disposed in alignment with said arrow.

2. A path puzzle apparatus comprising, a playing board provided with a plurality of hexagonally shaped spaces arrayed therein in combination with, a plurality of hexagonally shaped pieces for placement on said spaces, an arrow shaped direction indicating structure operably mounted on each of said pieces, said arrow disposed in a direction perpendicular to a side of said hexagon, travel distance indicia comprising a plurality of dots operably mounted on each of said arrow shaped indicating structures and disposed in alignment with said arrow.

* * * * *